US006655776B2

(12) United States Patent
Murray

(10) Patent No.: US 6,655,776 B2
(45) Date of Patent: Dec. 2, 2003

(54) MEDIA PACK FOR COMBINATION IMAGE ACQUISITION AND PRINTING DEVICE

(75) Inventor: Richard A. Murray, San Diego, CA (US)

(73) Assignee: Eastman Kodak Company, Rochester NY ( * ) Notice: Subject to any disclaimer, the term of this patent is extended or adjusted under 35 U.S.C. 154(b) by 0 days.

(21) Appl. No.: 09/858,331

(22) Filed: May 15, 2001

(65) Prior Publication Data

US 2002/0171698 A1 Nov. 21, 2002

(51) Int. Cl.[7] ..... B41J 2/01

(52) U.S. Cl. ..... 347/19; 347/2; 347/33; 347/86

(58) Field of Search ..... 347/1, 2, 85–87, 347/19, 33, 104

(56) References Cited

U.S. PATENT DOCUMENTS

| | | | | |
|---|---|---|---|---|
| 4,937,676 | A | | 6/1990 | Finelli et al. |
| 5,005,998 | A | | 4/1991 | Takanashi et al. |
| 5,610,635 | A | | 3/1997 | Murray et al. ..... 347/7 |
| 5,646,660 | A | | 7/1997 | Murray ..... 347/59 |
| 5,676,475 | A | | 10/1997 | Dull ..... 400/174 |
| 5,757,388 | A | | 5/1998 | Stephenson |
| 5,938,356 | A | | 8/1999 | Wirth et al. |
| 5,999,203 | A | | 12/1999 | Cane et al. |
| 6,000,773 | A | | 12/1999 | Murray et al. ..... 347/7 |
| 6,094,282 | A | | 7/2000 | Hoda et al. |
| 6,149,256 | A | | 11/2000 | McIntyre et al. |
| 6,227,643 | B1 | | 5/2001 | Purcell et al. ..... 347/19 |
| 6,238,044 | B1 | * | 5/2001 | Silverbrook et al. ..... 347/86 |
| 6,278,469 | B1 | * | 8/2001 | Bland et al. ..... 347/19 |
| 6,290,321 | B1 | | 9/2001 | Murray et al. ..... 347/19 |
| 6,375,298 | B2 | | 4/2002 | Purcell et al. ..... 347/14 |
| 6,435,676 | B1 | | 8/2002 | Murray et al. ..... 347/87 |
| 6,454,388 | B1 | * | 9/2002 | Bretl et al. ..... 347/36 |

* cited by examiner

*Primary Examiner*—Craig Hallacher
(74) *Attorney, Agent, or Firm*—Milton S. Sales; Thomas R. Arno

(57) ABSTRACT

A media pack for a combination image acquisition and ink jet printing apparatus comprises a housing configured for insertion into the combination digital camera and ink jet printing apparatus, a plurality of sheets of ink receiving media contained within the housing, and a plurality of ink reservoirs. A service station area and/or a memory element may also be provided.

9 Claims, 8 Drawing Sheets

MEDIA PACK FOR COMBINATION IMAGE ACQUISITION AND PRINTING DEVICE

BACKGROUND OF THE INVENTION

1. Field of the Invention

The present invention relates to electronic cameras and more specifically to the printing of images produced by such camera.

2. Description of the Related Art

Digital cameras, digital phones, PDAs and the like which obtain and display acquired images electronically are in widespread use. Digital images produced from these devices are typically stored in memory and these images can be shown on a display so that the user can determine which image should be stored for use in producing hard copy images. Typically, these images can be stored in a magnetic disk or a compact PCMCIA Flash RAM Card. Once stored, the image data is generally downloaded to a separate print apparatus for hard copy production.

More recently, attempts have been made to incorporate printing apparatus into the cameras themselves so that no separate printing apparatus is required. With such a combination camera/printing apparatus, images can be acquired and printed at any location, without waiting to perform a separate image download to other processing and print apparatus.

One example of this type of combination camera and printing apparatus is provided in U.S. Pat. No. 5,757,388 to Stephenson. This document shows an electronic imaging camera and an ink jet printing apparatus which can be interconnected for use either in combination or apart. In this device, the image acquisition apparatus is provided in one housing, and the printing apparatus is provided in a second separate housing. This device is thus essentially two separate devices with a means for coupling the two together. Another example camera/printing apparatus combination is provided by U.S. Pat. No. 6,149,256 to McIntyre. In this case, a single housing includes the image acquisition apparatus and a page wide print head. A separate housing is used to provide sheets of paper, ink, and a power supply for the printing apparatus. Although both of these documents describe combination camera and printing apparatus embodiments, neither is designed to optimize print quality while minimizing the size and cost of producing and operating the apparatus.

SUMMARY OF THE INVENTION

In one embodiment, the invention comprises a media pack for a combination image acquisition and ink jet printing apparatus. The media pack advantageously comprises a housing configured for insertion into the combination digital camera and ink jet printing apparatus, a plurality of sheets of ink receiving media contained within the housing, a plurality of ink reservoirs mounted to the housing, and a writeable and readable memory element attached to the housing. In one embodiment, the writeable and readable memory element is positioned on a top surface of the housing. In another embodiment, a media pack for a combination image acquisition and ink jet printing apparatus comprises a housing configured for insertion into the combination digital camera and ink jet printing apparatus, a plurality of sheets of ink receiving media contained within the housing, a plurality of ink reservoirs mounted to the housing, and a service station portion formed by the housing.

DETAILED DESCRIPTION OF THE PREFERRED EMBODIMENTS

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

The invention is directed to an imaging acquisition device and a compact ink jet printing apparatus contained in an integral housing. The imaging acquisition device could be a digital camera of conventional design and can capture either still or motion images. Such cameras often have a flat panel color display that is used to frame and/or review captured images.

Figure 1:
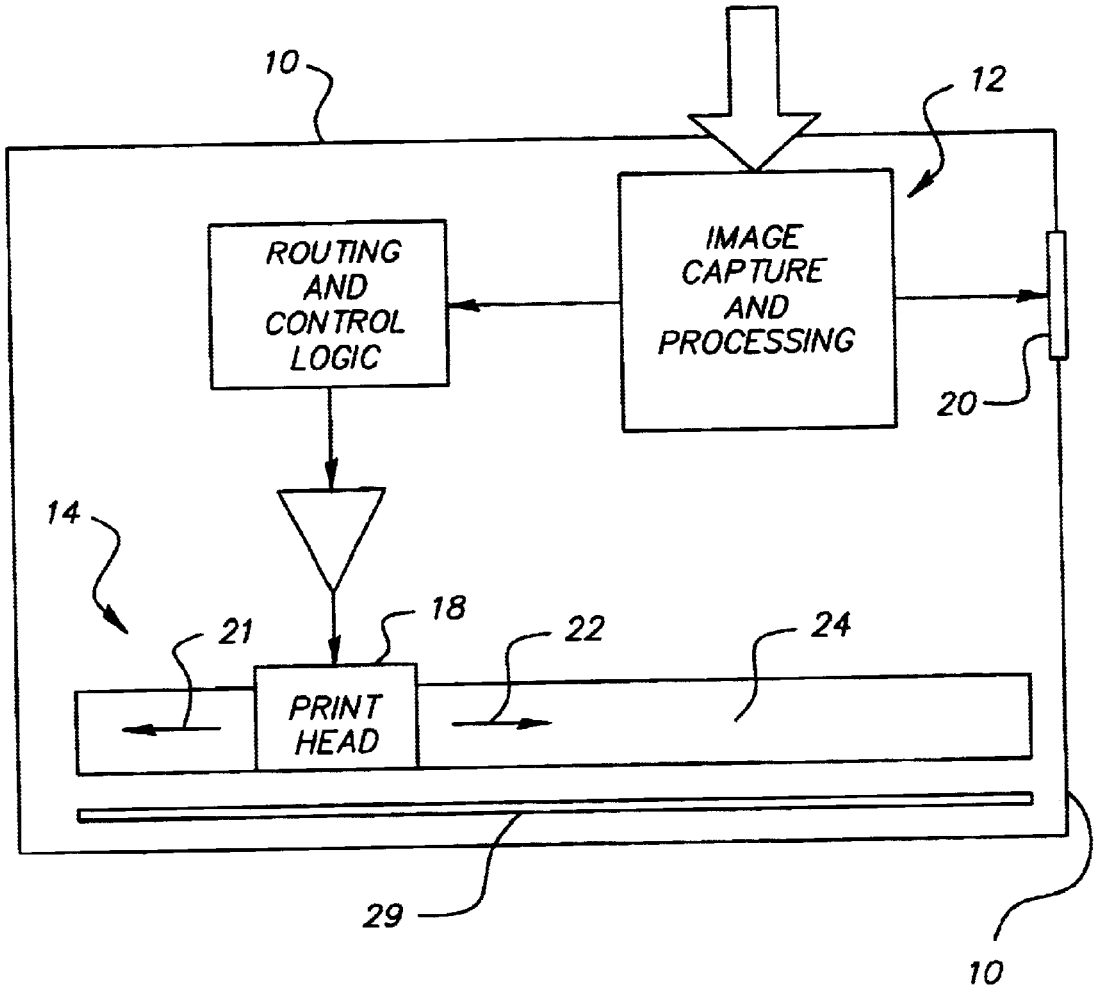
FIG. 1 is a block diagram of a digital camera and ink jet printing apparatus in an integral housing in accordance with the present invention.

Turning now to FIG. 1, a housing 10 with an image acquisition device 12 and an ink jet printing apparatus 14 is shown. Images are captured by the image acquisition device 12 which typically includes an optical system and an image sensor such as a CCD. The device may be a camera, PDA, cell phone, or any device that receives and stores images. Digital image data, which may be in raster format, from image capture circuitry 16 is transferred to a scanning print head 18 for hard copy image production as will be described in additional detail below. The image capture circuitry 16 may additionally include a storage memory for storing digital images captured by the system. These stored images may be used to drive a display 20 in a well known manner. Display 20 can be for instance a LCD or organic polymer display system of conventional design.

The image capture electronics processes the data and formats it for immediate printing by organizing the data in scan lines according to the physical layout of the ink jet print head. This organization allows the image capture electronics to perform a majority of the processing functions and thereby allows straightforward reproduction of image data by print the ink jet print head with minimal additional processing, thereby reducing redundant hardware including additional memory, resulting in reduction of the cost of the device.

In advantageous embodiments of the invention, the print head 18 contained within the housing 10 is a scanning print head which is moveable in the direction of arrows 21 and 22 along a guide rod 24 over a sheet of ink receiving media 29, typically paper. During the printing process, the media 29 is advanced in a first direction (out of the plane of FIG. 1) with a media advance drive member, while the scanning print head travels back and forth across the media 29 in a direction transverse to the first direction of media advance depositing swaths of ink droplets. In this manner, an image is formed by the ink jet printing apparatus. There are many advantages to the scanning print head over page wide non-moving ink jet head designs. Not only are smaller moving print heads less expensive and easier to replace, but they produce a higher print quality as well. This is because droplet deposition errors are randomized and spread throughout the image by the movement of the print head. With page wide print heads, droplet deposition errors tend to be systematic, occurring in bands within the image, and producing non correctable imperfections in print quality which are much more noticeable to the human eye than random errors. In one advantageous embodiment, the guide rod 24 on which the print head 18 is mounted also forms the media drive member. This is illustrated more fully in FIG. 2.

Figure 2:
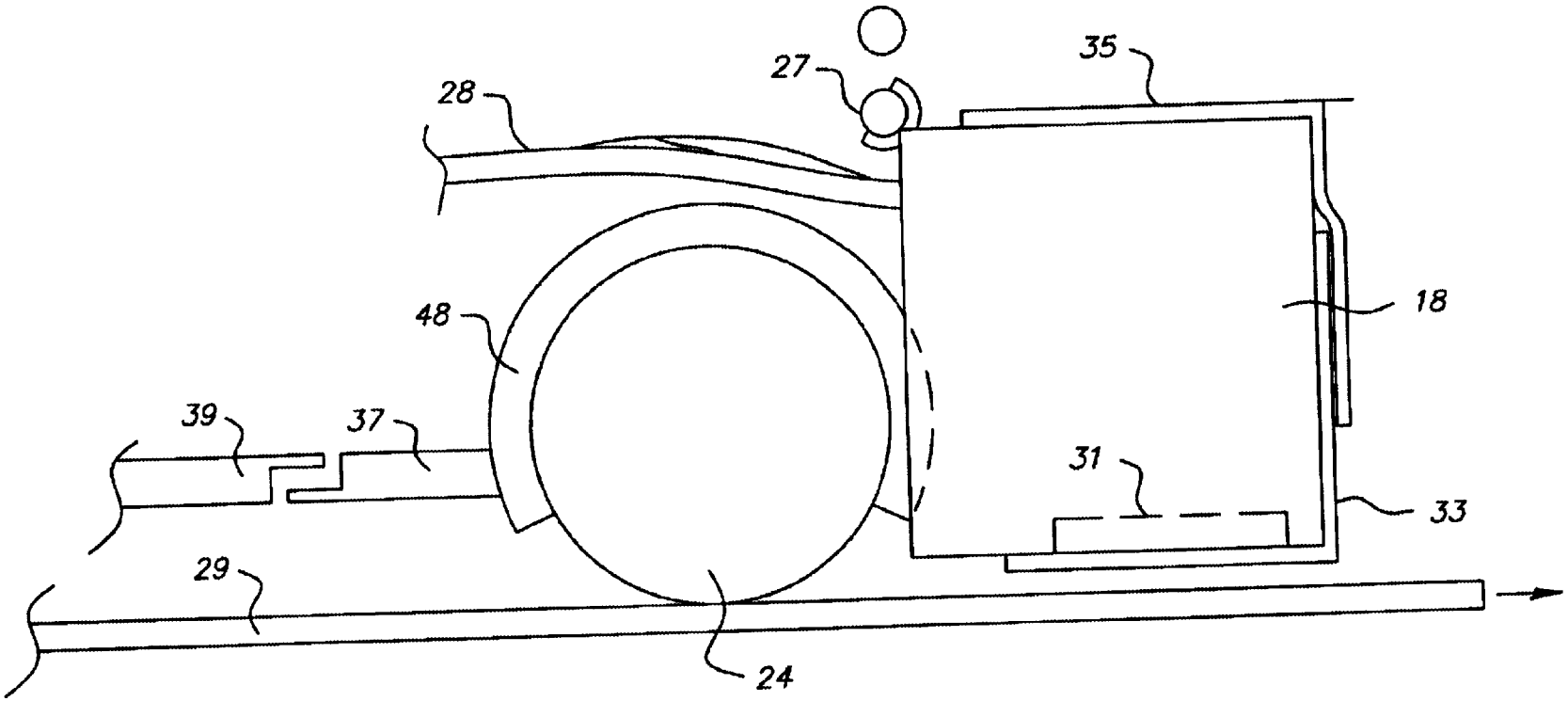
FIG. 2 is a cross sectional view of the printing apparatus assembly of FIG. 1 along the line 2—2 of FIG. 1.

FIG. 2 is a cross sectional view of the printing assembly 14 along lines 2—2 of FIG. 1. As seen in this Figure, the ink jet print head 18 may be mounted to or incorporate a bushing 48 which slidably engages the guide rod 24. The guide rod 24 is free to rotate within the bushing 48. The bottom surface of the guide rod 24 contacts the top sheet 29 of a stack of media such that when the guide rod 24 is incrementally rotated, the top media sheet 29 is also advanced. The print head is rotationally supported in a manner similar to that of conventional ink jet printer, with an extension 37 that slides along a support surface 39 that is behind the print head. Thus, the rotatable guide rod 24, disposed over the media stack, is actuated to advance one of the media sheets 50 past the ink jet print carriage 22 during the printing process.

To produce the transverse print head motion, the print head is coupled to a drive belt assembly 27. Other print head moving systems may utilize a motor and screw drive instead of drive belt. Ink supply tubing 28 supplies ink from ink reservoirs outside the print head 18. As in conventional ink jet print heads, the print head 18 has a jet plate 31 on its bottom surface containing nozzles for ink ejection. The jet plate is coupled to a flex circuit 33 which routes electrical signals to the jet plate for nozzle actuation. To produce a low profile head for small size, the flex circuit 33 is routed around to the front surface of the print head 1. Electrical contacts on this portion of the flex circuit 33 connect to mating electrical contacts on a second flex circuit 35 which is connected via a trailing cable connection to driver and routing control logic and to the processing circuitry 16 of FIG. 1 so as to control ink ejection during the image printing process. A specific advantageous method and apparatus for producing the desired media and print head motion is described in more detail below with reference to FIGS. 5, 6, and 7.

Figure 3A:
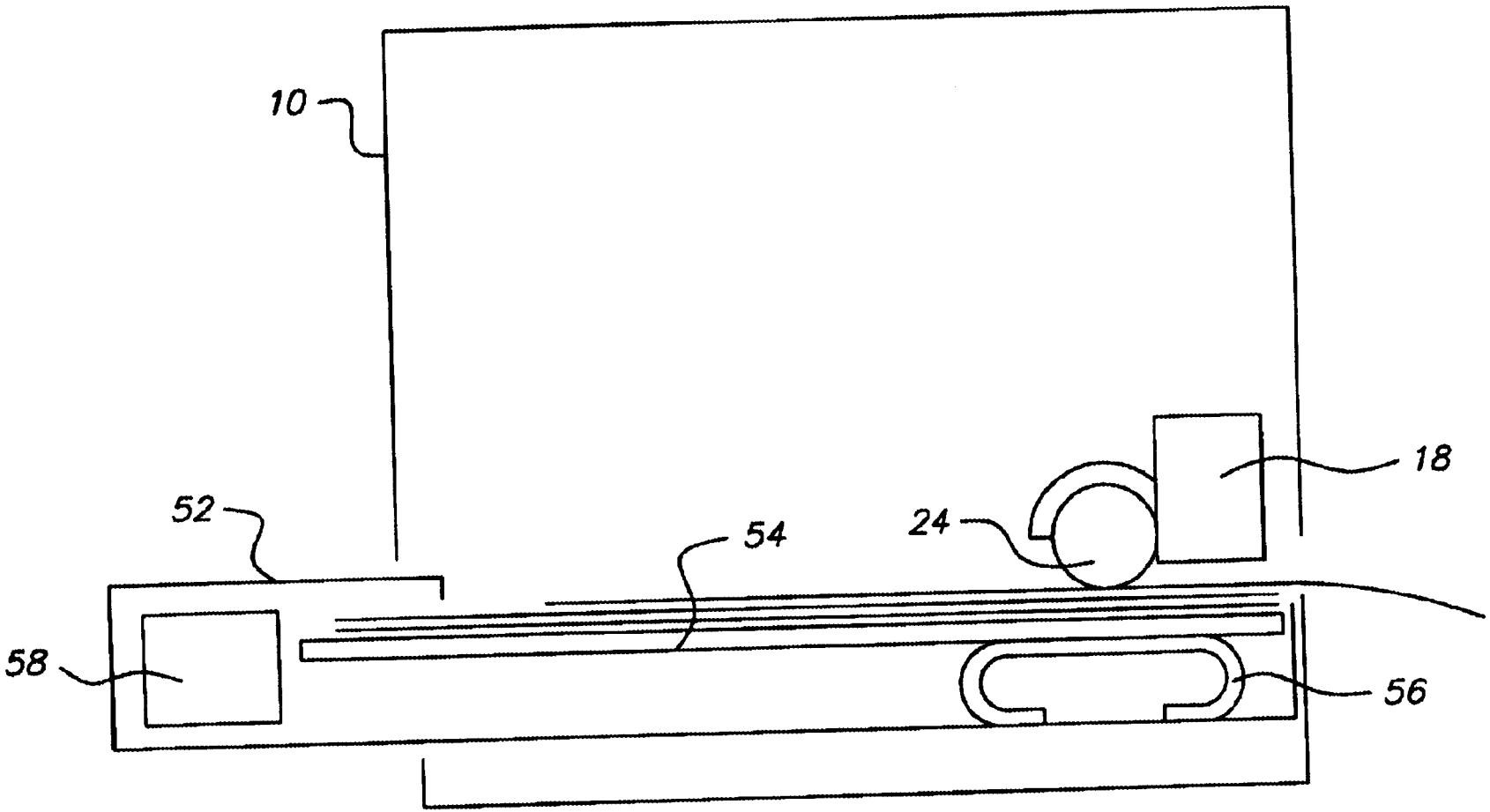
FIG. 3A is a cutaway side view of the camera/printing apparatus of FIGS. 1 and 2 with a removable media pack installed.
Figure 3B:
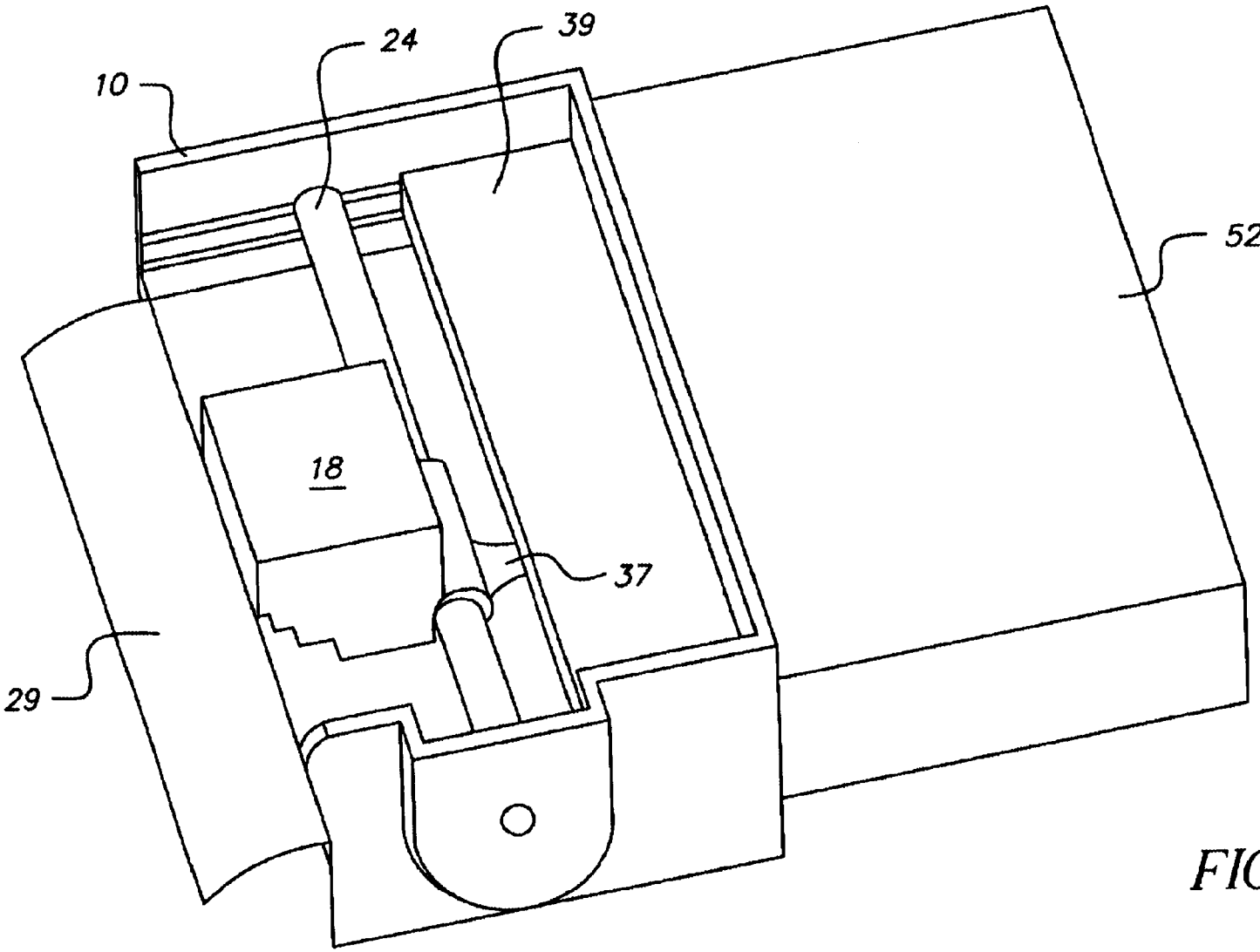
FIG. 3B is a perspective view of the camera/printing apparatus of FIGS. 1 and 2 with the camera housing cut away.

In one embodiment, illustrated in FIGS. 3A and 3B, the media sheets are housed in a media pack that is user insertable into and user removable from the housing 10 containing the image acquisition and printing apparatus. The media may thus be incorporated into a second housing 52 separate from the first housing 10, forming an inexpensive, disposable media pack for the camera/printing system. In some advantageous embodiments, the second housing 52 may be inserted into the first housing 10 from the rear. In one media pack embodiment, the media sheets rest on a spring loaded platen 54. A biasing member 56 urges the platen 54 with the media sheets 50 against the guide rod/drive roller 24. The second housing 52 may also include an ink reservoir 58 which couples to the ink supply tubing 28 when the media housing 52 is installed in the camera/printing apparatus housing 10.

The relationship between the media pack and printing apparatus when the media pack housing 52 is installed in the housing 10 is such that print head travel is over the front portion of the media pack housing 52 and above the media sheets as they sit inside the housing 52. This reduces the total size of the device as media sheets need not be advanced to a printer assembly which is spatially separated from the media source in order to initiate the print process. As will be explained further below, this arrangement also allows a print head service station area to be incorporated into the media pack.

Figure 4:
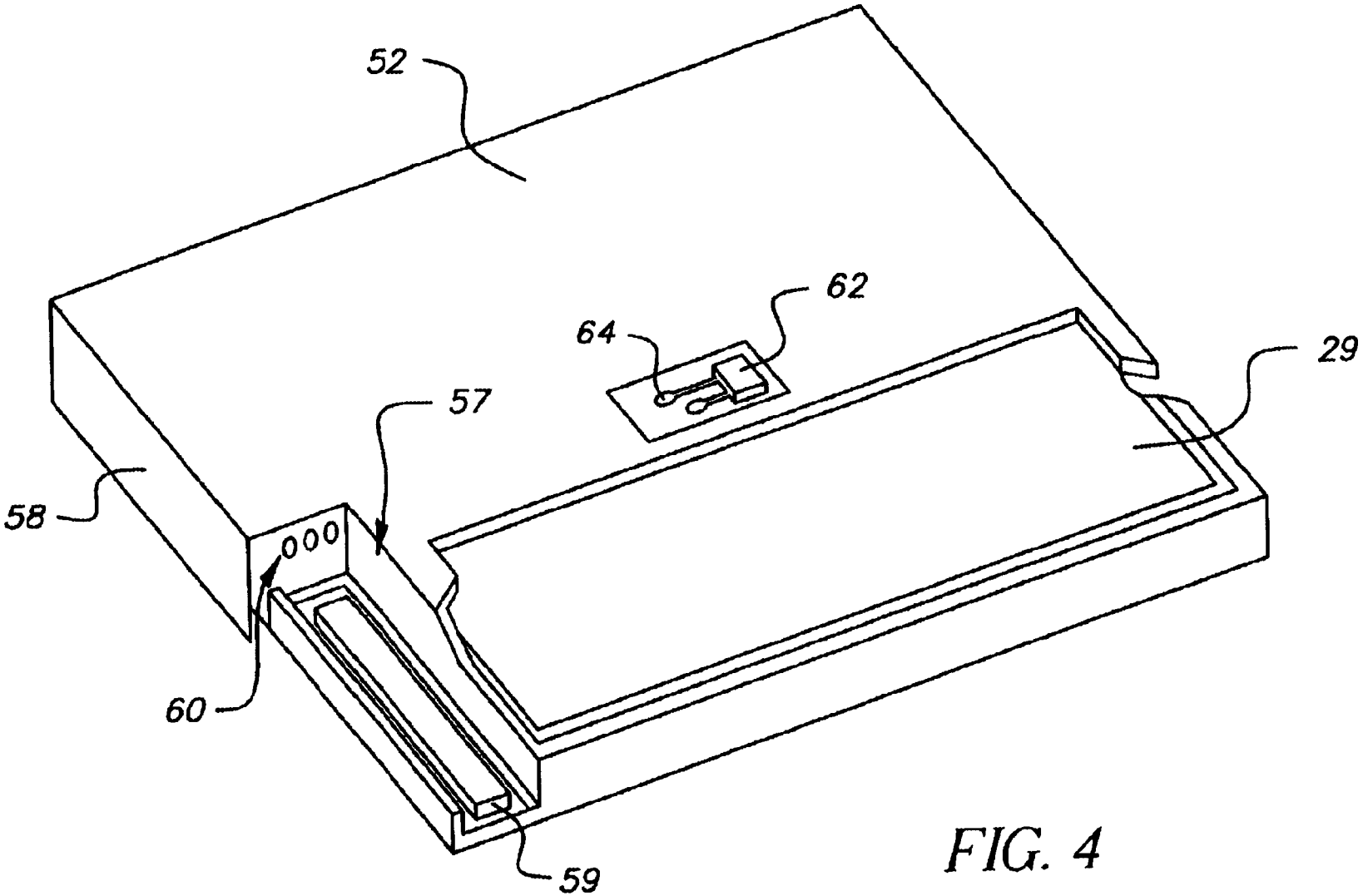
FIG. 4 is a perspective view of the removable media pack of FIG. 3 removed from the camera.

FIG. 4 is a perspective view of the removable media pack illustrated in FIG. 3. The housing 52 includes media 30, which is exposed to contact from the guide rod/drive roller 24 when installed in the camera/printing apparatus. Also provided are ink outlets 60 for coupling to the ink supply tubing 28. In one advantageous embodiment, the media pack includes a writable and readable memory element 62, such as a FLASH memory. With this memory element 62, not only can initial characteristics of the media pack be stored, such as ink or media type, or initial number of media sheets provided, but also, the information can be updated so that the user can be kept informed, for example, of how many media sheets are left or how many have been used. Also, if the media pack is removed from the camera & later reinserted, the camera may automatically determine the number of sheets left. When sheets are used up or low, the camera knows this and may stop printing requests or notify user to replace with a new media pack. The memory element may incorporate a two pin serial bus which allows easy access by the image processing apparatus. Using this common serial bus technique, power may also be provided without use of additional interface pins. Such memory devices are commercially available from Dallas Semiconductors and others.

The memory element is advantageously placed on the top surface of the housing 52 and is connected to electrical contacts 64 for interfacing with the electronics in the camera/printing apparatus. Referring back to FIG. 3B, this placement allows the electrical contacts 64 to mate with contacts on a main printing apparatus circuit board (not shown) mounted to the shelf 39 in the camera housing 10. This eliminates the need to provide an additional interface circuit board in the camera housing to interface with the memory element contacts 64, thus minimizing the cost and size of the device.

In addition, the housing 52 may include a print head service station area 57 with an ink absorbent foam pad 59. During printing, the print head can travel past the media edge and eject droplets (or "spit") over the foam pad 59 to clear nozzles. This area may also include other components (not shown) such as a print head wiper and a rubber seal for sealing the ink jet print head when not in use, as are commonly provided on larger scale ink jet printers. When idle, the print head would reside over this area of the media pack above the foam pad and sealed, if a seal is provided. With this embodiment, mess from waste ink and print head servicing is quickly disposed of with each replacement of the media pack.

Figure 5:
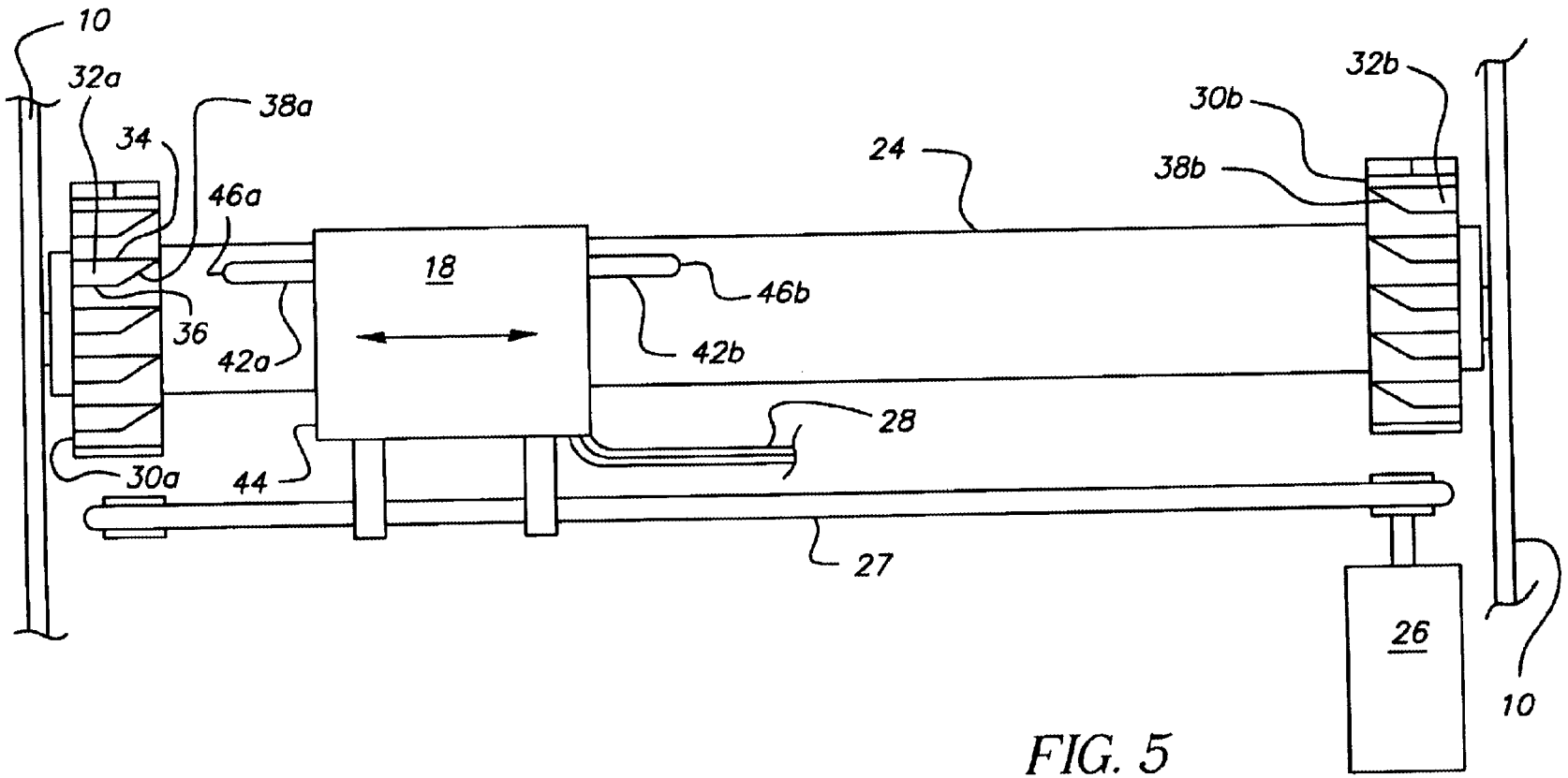
FIG. 5 is a top view of an ink jet printing apparatus carriage assembly with cam structures for media advance.
Figure 6A:
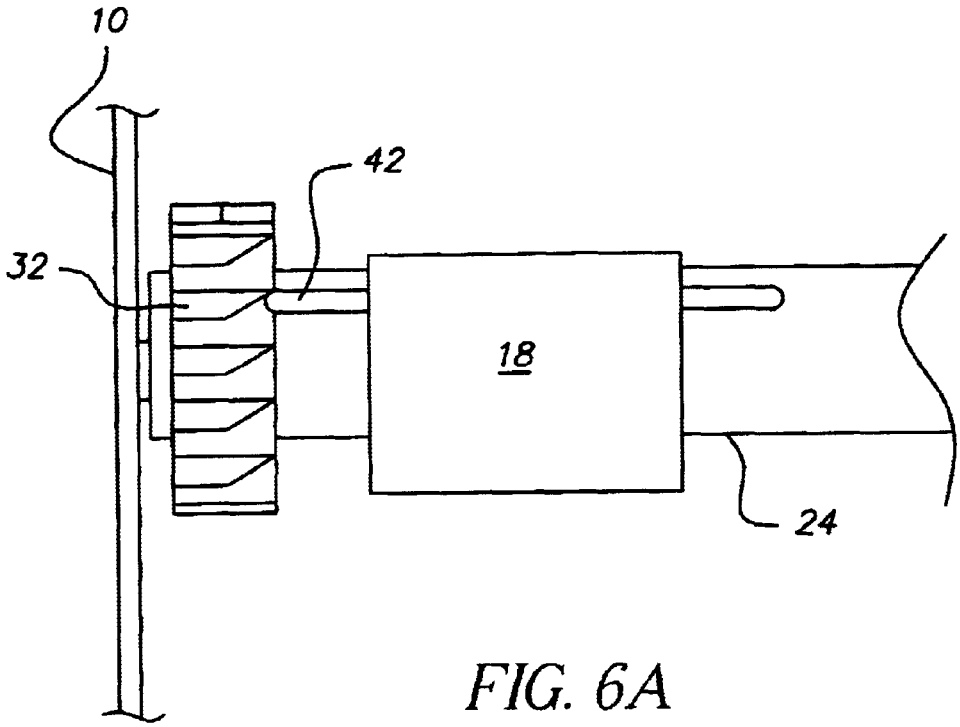
FIG. 6A is a top view of the assembly of FIG. 5 with the cam in a first position.
Figure 6B:
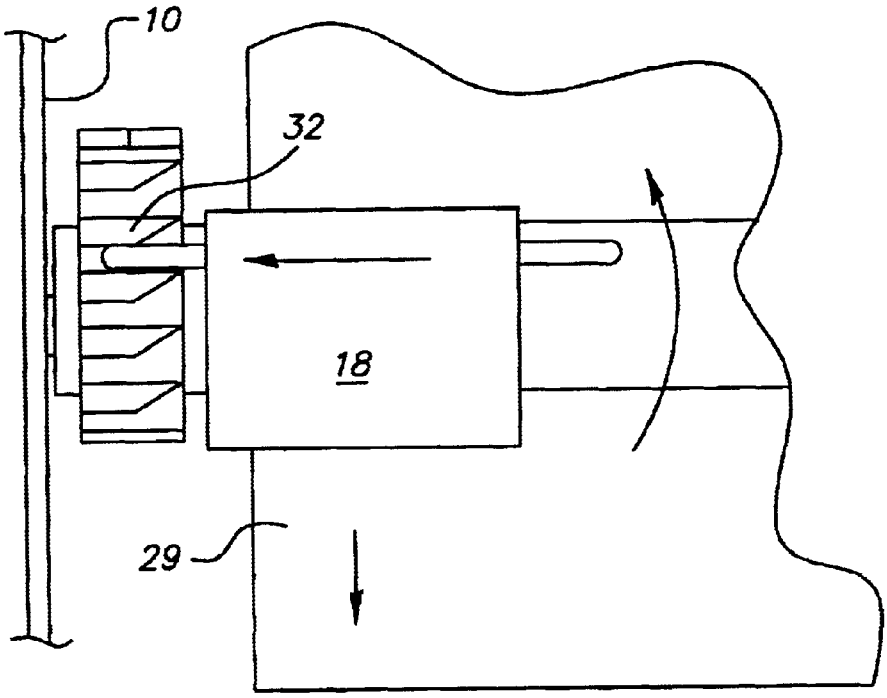
FIG. 6B is a top view of the assembly of FIG. 5 with the cam rotated to a second position.

Turning now to FIGS. 5, 6A, and 6B, an advantageous print head and media advance mechanism is described. The embodiments shown in these figures are especially advantageous in this application because only a single motor is required to advance both the print head and the media. This allows for both space and cost savings in a combined camera/printing apparatus.

Referring now to FIG. 5, a bidirectional printing apparatus (wherein ink is deposited when the print head moves in both directions across the media) is illustrated. As described above, the ink jet print head 18 is slidably mounted on the guide rod and paper drive roller 24 to enable motion of the ink jet print head along the paper drive roller 24 and to define a linear path, as shown by the bi-directional arrow in FIG. 5, along which the ink jet print head 22 moves. A motor 26 and drive belt mechanism 27 (or screw drive, for example) are used to drive the ink jet print head 18 along the paper drive roller 24.

The paper drive roller 24 is attached at each end to a cam 30*a,* 30*b.* The cams 30 are generally circular disks with a plurality of protrusions 32*a,* 32*b* on their outer circumference. Each protrusion 32 is configured 30 such that a driving surface 38*a,* 38*b* is created at an angle relative to the inner face 40 of the protrusion 32. Alternately, other embodiments of protrusions 32 can be used that provide driving surfaces on the cams 30.

The print head 18 includes extended actuators 42*a,* 42*b* protruding from the sides of the print head 18. A protruding end 46*a,* 46*b* of the actuator may be shaped at an angle or it may be rounded so that each protruding end 46 can engage with the driving surface 38 of one of the protrusions 32 on the cam 30.

As the print head 18 reaches one end of travel along the paper drive roller 24, the drive motor 26 pushes the protruding end 46*a* of the actuator against the driving surface 38*a* of a protrusion on the end of cam 30*a,* causing the cam 30*a* (and the attached drive roller) to rotate from a first position as shown in FIG. 6A to a second position as shown in FIG. 6B. The rotation of the cam 30 rotates the paper drive roller 24, thereby advancing the media sheet 50 an incremental amount.

When the print head 18 travels back to the other side of the roller 24, the actuator 42*b* on the other side of the print head contacts the driving surface 38*b* on the other cam 30*b,* causing a similar rotation of the paper drive roller. The protrusions on the cam 30*a* are rotationally out of phase with the protrusions on the cam 30*b,* such that the rotation caused at one end positions the protrusions on the cam at the other end into the proper position to be engaged with the other actuator.

Accordingly, a printed image is formed on the media sheet 50 by advancing the media sheet in incremental amounts using paper drive roller 24 each time the print head 18 reaches an end of travel along the paper roller 24.

Figure 7A:
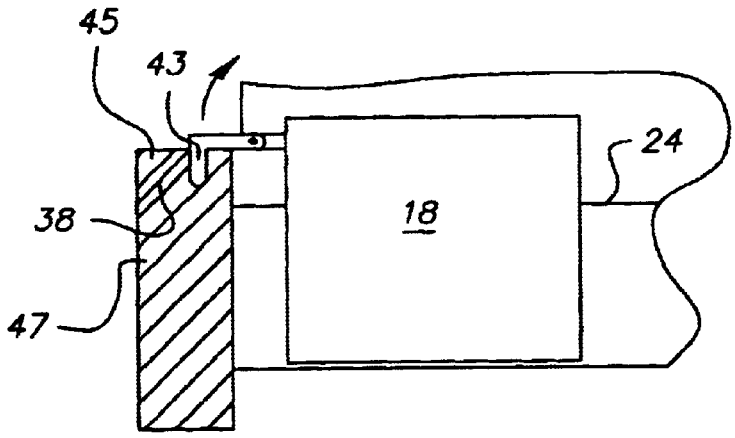
FIG. 7A is a side view of a second embodiment of a cam structure for media advance.
Figure 7B:
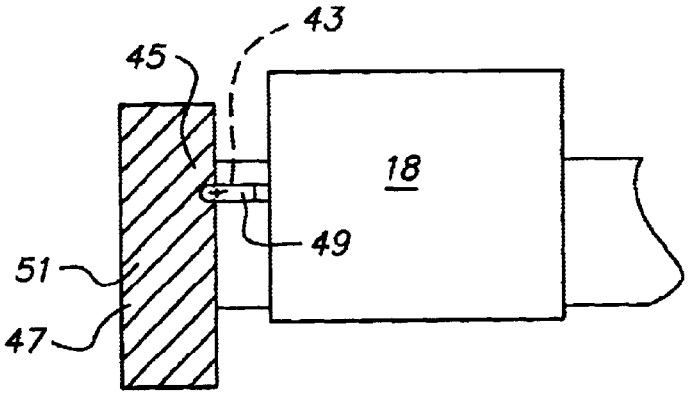
FIG. 7B is a top view of the embodiment of FIG. 7A with the cam in a first position.
Figure 7C:
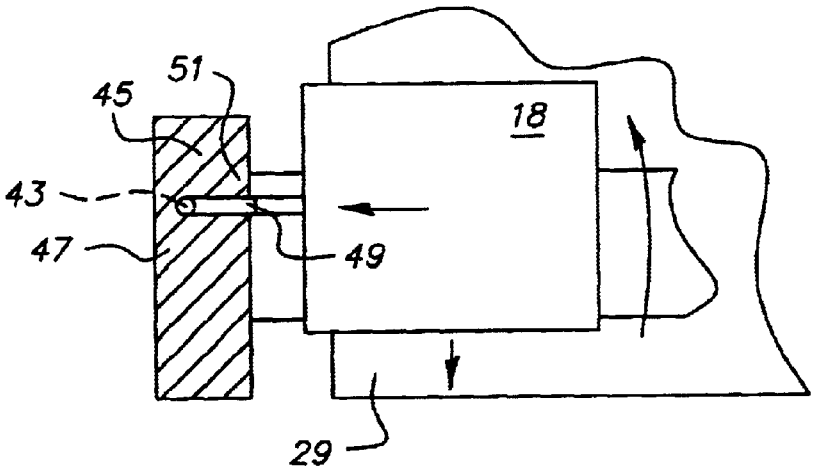
FIG. 7C is a top view of the embodiment of FIG. 7A with the cam rotated to a second position.

Another embodiment suitable for unidirectional printing (wherein ink is deposited during only one direction of print head travel) is shown in FIGS. 7A, 7B, and 7C. In this case, only one cam 30 is required. In this embodiment, the protrusion 42 may comprise an articulating arm with a downwardly projecting tip 43 as shown in the side view of FIG. 7A. As the print head 18 moves toward the cam 30, the tip 43 moves along the driving surface 38 of a protrusion 45 advancing the cam 30. During this process, the tip 43 moves behind the adjacent protrusion 47 and in the gap 51 between the protrusion 45 and the protrusion 47, while the horizontally extending portion 49 of the actuator passes over the top of the adjacent protrusion 47 as shown in FIGS. 7B and 7C. The arm is hinged such that on return motion, the tip 43 can rise up and over the rear surface of the adjacent protrusion 47, releasing the cam 30 as the print head moves away toward the other side of the roller 24. When the print head returns on the next pass, the tip 43 is positioned to engage the front of the adjacent protrusion 47, again advancing the cam 30 and the roller 24. In this way, the media advance is accomplished in a single sided operation.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A media pack for a combination image acquisition and ink jet printing apparatus, said media pack comprising:

a housing configured for insertion into said combination image acquisition and ink jet printing apparatus;

a plurality of sheets of ink receiving media contained within said housing;

a plurality of ink reservoirs mounted to said housing; and a writeable and readable memory element attached to said housing.

2. The media pack of claim 1, wherein said writeable and readable memory element includes contacts configured to connect to mating contacts on said image acquisition and ink jet printer apparatus, whereby said memory element is updated by said combination image acquisition and ink jet printer apparatus as said plurality of sheets of ink receiving media are used.

3. The media pack of claim 1, wherein said writeable and readable memory element comprises a power input contact configured to connect to a power output contact on said combination image acquisition and ink jet printer apparatus.

4. The media pack of claim 1, wherein said writeable and readable memory element is positioned on a top surface of said housing.

5. The media pack of claim 1, additionally comprising a print head service station area.

6. The media pack of claim 5, wherein said service station area comprises ink absorbent foam.

7. A media pack for a combination image acquisition and ink jet printing apparatus, said media pack comprising:

a housing configured for insertion into said combination image acquisition and ink jet printing apparatus;

a plurality of sheets of ink receiving media contained within said housing;

a plurality of ink reservoirs mounted to said housing; and a service station portion formed by said housing, wherein said service station is integrally formed as a side portion of said housing, wherein said service station further comprises an ink absorbent foam pad, and wherein said service station is formed on the side of the housing adjacent to the edge of the media such that a print head can travel past the edge of said media and eject droplets over said foam pad of said service station.

8. The media pack of claim 7, further comprising a print head wiper.

9. The media pack of claim 7, further comprising a rubber seal for sealing an ink jet print head when the ink jet print head is not in use.

* * * * *